US010897987B2

(12) United States Patent
Ballot et al.

(10) Patent No.: US 10,897,987 B2
(45) Date of Patent: Jan. 26, 2021

(54) DUAL SEAL FOR BRUSH APPLICATOR

(71) Applicant: FLOCON, Inc, Woodstock, IL (US)

(72) Inventors: Stephan M Ballot, Barrington Hills, IL (US); Robert D Forschler, Lakewood, IL (US)

(73) Assignee: Flocon Inc., Woodstock, IL (US)

( * ) Notice: Subject to any disclaimer, the term of this patent is extended or adjusted under 35 U.S.C. 154(b) by 0 days.

(21) Appl. No.: 16/235,213

(22) Filed: Dec. 28, 2018

(65) Prior Publication Data

US 2019/0200745 A1 Jul. 4, 2019

Related U.S. Application Data

(60) Provisional application No. 62/611,862, filed on Dec. 29, 2017.

(51) Int. Cl.

| | |
|---|---|
| ***A46B 11/00*** | (2006.01) |
| ***A45D 34/04*** | (2006.01) |
| ***A45D 40/26*** | (2006.01) |

(52) U.S. Cl.

CPC ..... *A46B 11/0086* (2013.01); *A45D 34/045* (2013.01); *A45D 34/046* (2013.01); *A45D 40/265* (2013.01); *A45D 40/267* (2013.01); *A46B 2200/1046* (2013.01)

(58) Field of Classification Search

CPC .... A45D 34/045; A45D 34/046; A45D 29/00; A45D 34/042; A45D 40/262; A45D 40/265; A45D 40/267; A46B 11/0086; A46B 11/00; A46B 2200/1046

See application file for complete search history.

(56) References Cited

U.S. PATENT DOCUMENTS

| | | | | |
|---|---|---|---|---|
| 3,756,731 | A * | 9/1973 | Aubry | A45D 40/267 401/122 |
| 6,502,584 | B1 * | 1/2003 | Fordham | A45D 34/046 132/218 |
| 7,104,716 | B2 * | 9/2006 | Petit | A45D 40/24 401/122 |
| 2014/0301764 | A1 | 10/2014 | Eberlein et al. | |
| 2017/0258204 | A1 | 9/2017 | Yoo et al. | |

FOREIGN PATENT DOCUMENTS

| | | |
|---|---|---|
| EP | 1.614.367 B1 | 10/2007 |
| WO | WO 2009/019393 A2 | 2/2009 |
| WO | WO 2013/017597 A1 | 2/2013 |

* cited by examiner

*Primary Examiner* — David J Walczak

(74) *Attorney, Agent, or Firm* — Frijouf, Rust & Pyle, P.A.

(57) ABSTRACT

A dual seal for a liquid applicator for applying a liquid from a container. The dual seal comprises a container having an open end with a container fastener. A closure having a closure fastener engages with the container fastener for forming a first seal between the closure and the liquid container. A rod extends from the closure for supporting a liquid applicator. A circumferential projection ends from a rod. A resilient partially conical wiper extends from the container for sealing with the circumferential projection of the rod for forming a second seal between the closure and the liquid container. The resilient partially conical wiper engages the liquid applicator upon removal of the liquid applicator from the container for removing excess liquid from the liquid applicator.

4 Claims, 4 Drawing Sheets

DUAL SEAL FOR BRUSH APPLICATOR

CROSS-REFERENCE TO RELATED APPLICATIONS

This application claims benefit of U.S. Patent Provisional application No. 62/611,862 filed 29 Dec. 2017. All subject matter set forth in provisional application No. 62/611,862 filed 29 Dec. 2017 is hereby incorporated by reference into the present application as if fully set forth herein.

BACKGROUND OF THE INVENTION

Field of the Invention

This invention relates to the dispensing of liquids and more particularly, this invention relates to an improved dual seal for a brush applicator stored within a container.

Description of the Related Art

Brushes have been used for thousands of years for providing a controlled application of a liquid onto a surface. One specialized application of a brush applicator is a brush in a bottle. In a brush in a bottle, a brush applicator is secured to a closure and is stored within a container (bottle) during non-use and/or storage. The container (bottle) may be glass, plastic metal or the like.

The brush in a bottle is generally used to dispense small quantities of liquids. Examples of common uses of a brush in a bottle include nail polish, correction fluid, touchup paint and the like.

Although the brush in a bottle has been used in various forms for many years, the brush in the bottle suffers from two major defects. Firstly, many of the brush in the bottle unit leaks between the closure and the bottle of container. Secondly, in many case, excess liquid is extracted from the container by the brush. The excess liquid on the liquid applicator can cause uncontrolled application of the liquid onto a surface.

Therefore, it is an object of this invention to overcome the deficiencies of the prior art and to provide a significant advancement in the art.

Another object of the present invention is to provide a dual seal for a liquid applicator for applying a liquid from a container that provides the security of a dual seal.

Another object of the present invention is to provide a dual seal for a liquid applicator that provides a wiper for removing excess liquid from the liquid applicator prior to use.

Another object of the present invention is to provide a dual seal for a liquid applicator that provides a dual seal and a wiper while providing the same time of assembly.

Another object of the present invention is to provide a dual seal for a liquid applicator that provides a dual seal and a wiper while using the same number of parts as the prior art.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly, other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention comprises a dual seal for a liquid applicator for applying a liquid from a container comprising a container having an open end with a container fastener. A closure has a closure fastener for engaging with the container fastener for forming a first seal between the closure and the liquid container. A rod extends from the closure for supporting a liquid applicator. A circumferential projection extends from the rod. A resilient partially conical wiper extends from the container for sealing with the circumferential projection of the rod for forming a second seal between the closure and the liquid container.

In a more specific embodiment of the invention, the rod extends between a first end and a second end. The first end of the rod is connected to the closure. The second end of the rod supports the liquid applicator. The closure includes a socket for receiving the first end of the rod. The circumferential projection provides a stop for limiting insertion of the first end of the rod into the socket in the closure. Preferably, the circumferential projection is a generally cylindrical projection extending from the rod.

In another example of the invention, the liquid applicator is a brush. The resilient partially conical wiper engages the liquid applicator upon removal of the liquid applicator from the container for removing excess liquid from the liquid applicator.

In still a further example of the invention, the container fastener includes container threads. The closure fastener includes closure threads for engaging with the container threads for forming a first seal between the closure and the container. The first seal comprises at least one of the container ends and the closure ends forming a compression seal with the other of the closure and the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
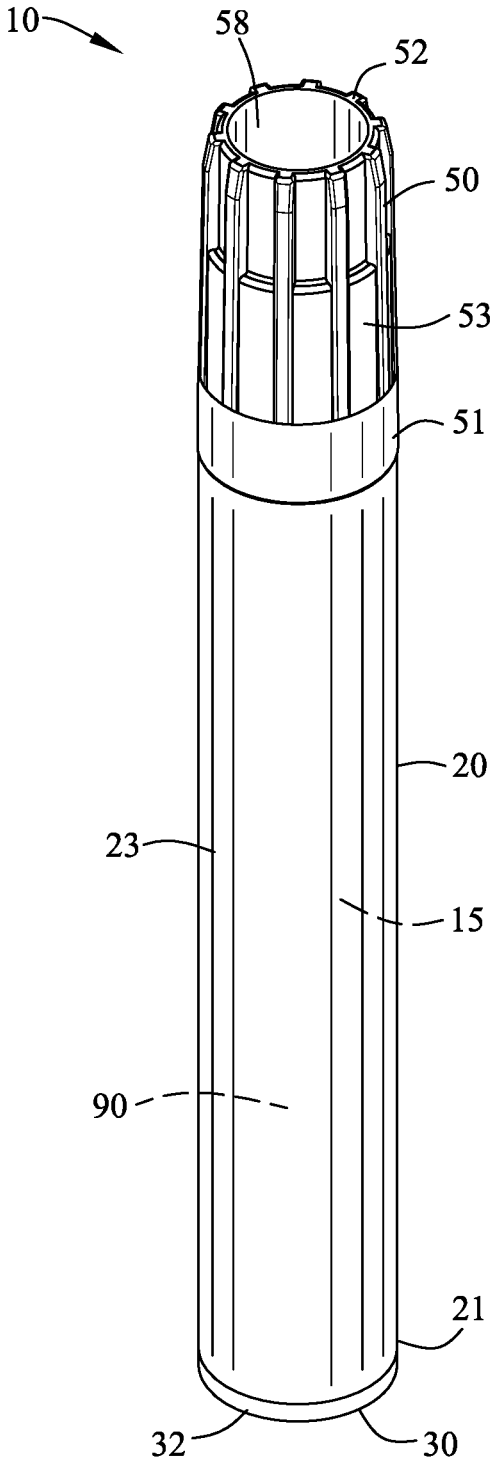
FIG. 1 is top isometric view of a brush stored within a liquid container incorporating the present invention.
Figure 3:
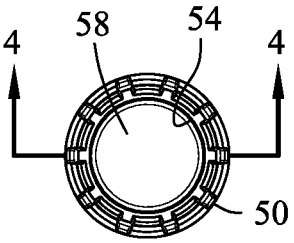
FIG. 3 is top view of FIG. 2.
Figure 2:
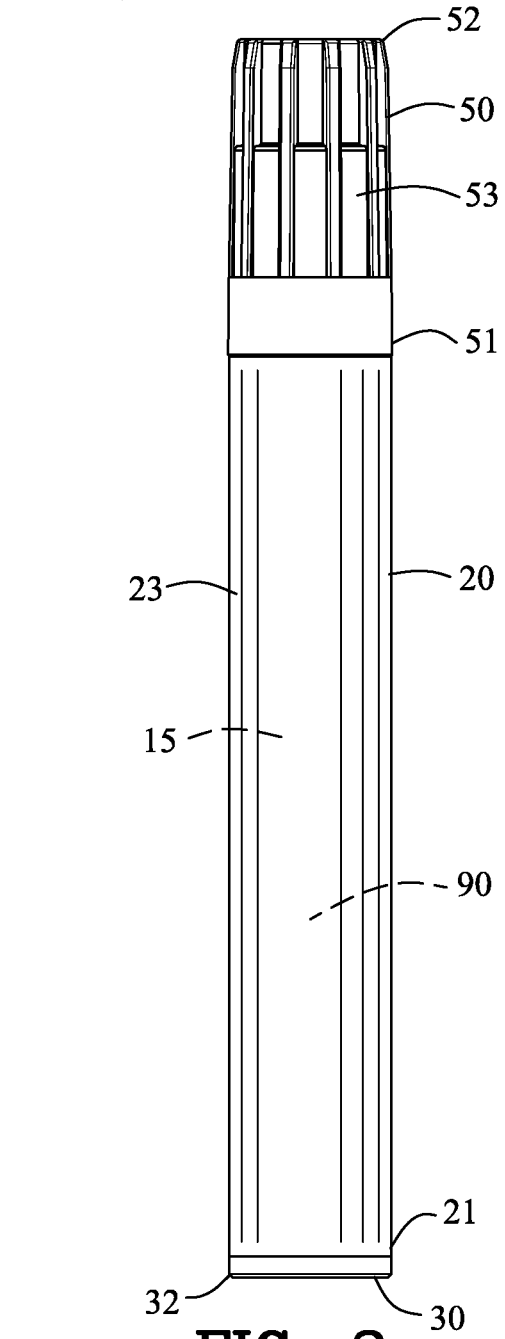
FIG. 2 is a side view of the liquid applicator device of FIG. 1.
Figure 4:
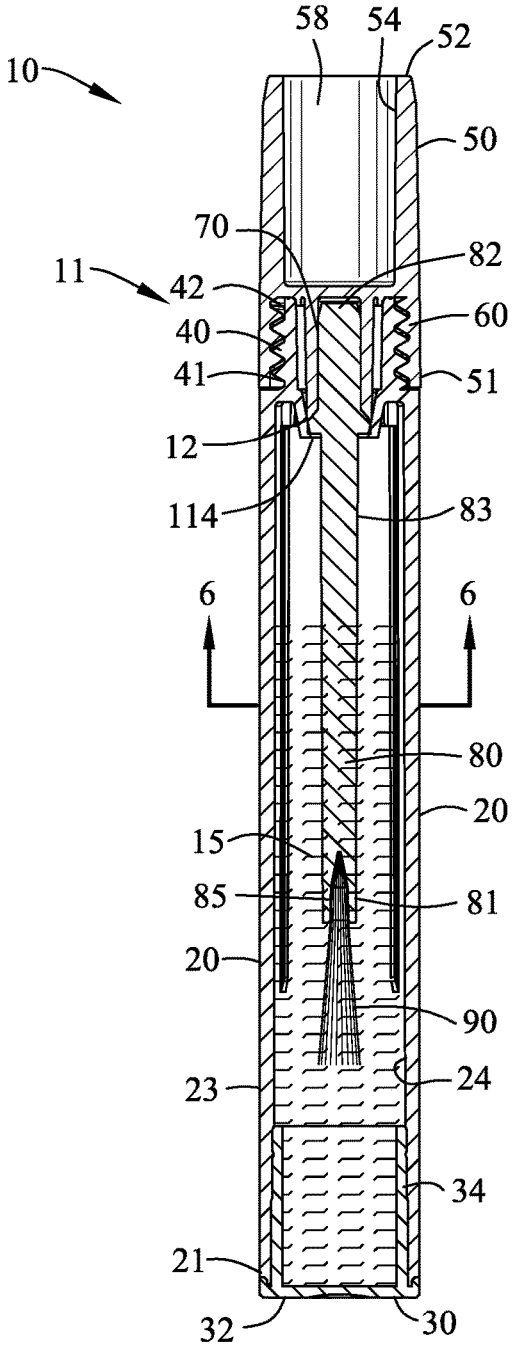
FIG. 4 is a sectional view along line 4-4 in FIG. 3.
Figure 5:
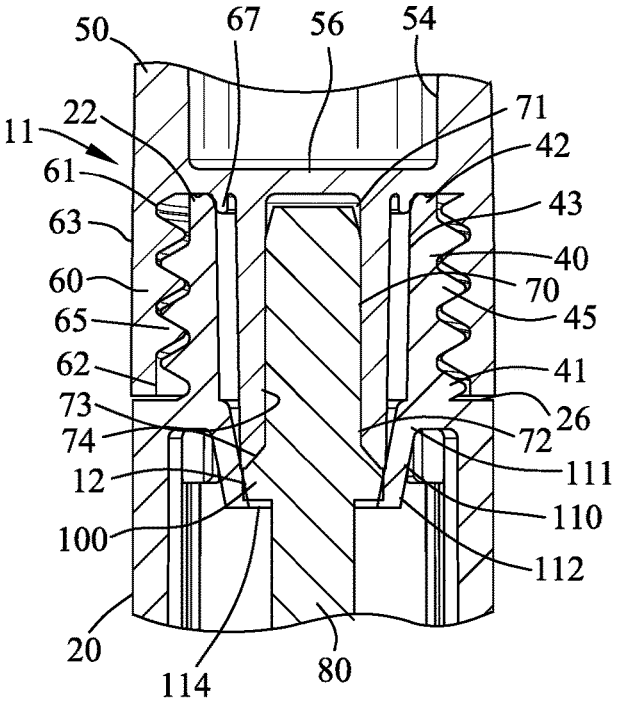
FIG. 5 is an enlarged view of a portion of FIG. 4.
Figure 6:
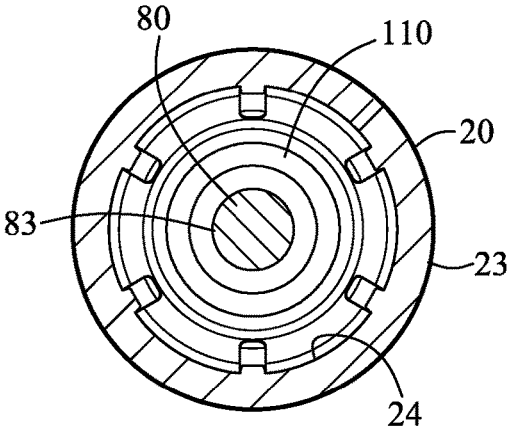
FIG. 6 is an enlarged sectional view along line 6-6 in FIG. 4.

FIGS. 1-6 are various views of a dual seal for a liquid applicator 10 for providing a first and a second seal 11 and 12 for a liquid 15 within a container 20. The container 20 extends between a first end 21 and a second end 22. The container 20 defines an outer sidewall 23 and an inner sidewall 24. Preferably, the container 20 is formed from a one-piece polymeric material.

The first end 21 of the container 20 is open for facilitating molding of the container 20. A plug 30 comprising a cap 32 and an insert 34 seals the first end 21 of the container 20. In this example, the insert 34 engages the inner sidewall 24 of the container 20 in a press-fit engagement.

The second end 22 of the container 20 is an open end for enabling the removal of the liquid 15 from the container 20. A shoulder 26 extends inwardly from the outer sidewall 23 of the container 20. The shoulder 26 supports a closure fastener 40. The container fastener 40 extends from a proximal end 41 to a distal end 42 and defines a substantially cylindrical sidewall 43 having integral container threads 45.

A closure 50 extends between a first end 51 and a second end 52. The closure 50 defines an outer sidewall 53 and an inner sidewall 54. A transverse member 56 extends across the closure 50. The transverse member 56 defines a void 58 between the transverse member 56 and the second end 52 of the closure 50. Preferably, the closure 50 is formed from a one-piece polymeric material.

A closure fastener 60 extends from a proximal end 61 to a distal end 62 and defines a substantially cylindrical sidewall 63 having integral closure threads 65. An annular bias 67 extends from the transverse member 56 to toward the first end 51 of the closure 50.

The closure threads 65 of the closure 50 engage with the container threads 45 of the container 20 for forming a first seal 11 between the closure 50 and the liquid container 20. The thread engagement between the closure threads 65 and the container threads 45 creates a compression first seal 11 with at least one of the second end 22 of the container 20 and the transverse member 56 and the other of the first closure end 51 and the shoulder 26. In addition, the annular bias 67 biased the second end 22 of the container 20 into engagement with the transverse member 56.

Although the closure fastener 40 and the closure fastener 60 have been shown utilizing a threaded engagement to create a first seal 11 between the container 20 and the closure 50, it should be understood that various other devices may be utilized to form the first seal 11 between the container 20 and the closure 50 by those skilled in the art.

A closure 50 includes a socket 70 extending from the transverse member 56 to toward the first end 51 of the closure 50. The socket 70 extends from a proximal end 71 to a distal end 72 to define a substantially cylindrical inner sidewall 73. The distal end 72 of the socket 70 is angled 74 for facilitating insertion into the socket 70 as will be explained in greater hereinafter.

A rod 80 extends from the closure 50 for supporting a liquid applicator 90. The rod 80 extends between a first end 81 and a second end 82 defining an outer sidewall 83. The first end 81 of the rod 80 is configured to receive the liquid applicator 90. In this example, the first end 81 of the rod 80 includes a respite 85 for mounting a brush applicator 88. Although the liquid applicator 90 has been shown as a brush applicator 88, it should be understood that various other type applicators may be utilized as should be well known to those skilled in the art.

The second end 82 of the rod 80 is connected to the closure 50. The second end 82 of the rod 80 is received within the socket 70 in a press-fit engagement, a frictional engagement, an adhesive engagement or the like. The angle 74 of the distal end 71 of the socket 70 facilitates insertion of the second end 82 of the rod 80 into the socket 70.

The second seal 12 is formed between a circumferential projection 100 formed on the rod 80 and a wiper seal 110 extending from the shoulder 26 of the container 20.

The circumferential projection 100 extends from the rod 80 in proximity to the second end 82 of the rod 80. The circumferential projection 100 is a generally cylindrical projection extending from the rod 80. An edge of generally cylindrical projection of the circumferential projection 100 engages the distal end 71 of the socket 70 and functions as a stop for limiting the insertion of the rod 80 into the socket 70.

The wiper seal 110 extends from the shoulder 26 of the container 20. The wiper seal 110 is a resilient partially conical wiper extending from a support surface Ill integral with the shoulder 26 of the container 20 to a depending end 112. The depending end 112 of the wiper seal 110 defines an aperture 114. The aperture 114 defined by the depending end 112 of the wiper seal 110 has a diameter greater than the cross-section of the rod 80.

The aperture 114 defined by the depending end 112 of the wiper seal 110 is fashioned to resiliently engage with the circumferential projection 100. The resilient engagement of the aperture 114 defined by the depending end 112 of the wiper seal 110 with the circumferential projection 100 forms the second seal 12 between the closure 50 and the liquid container 20.

Figure 7:
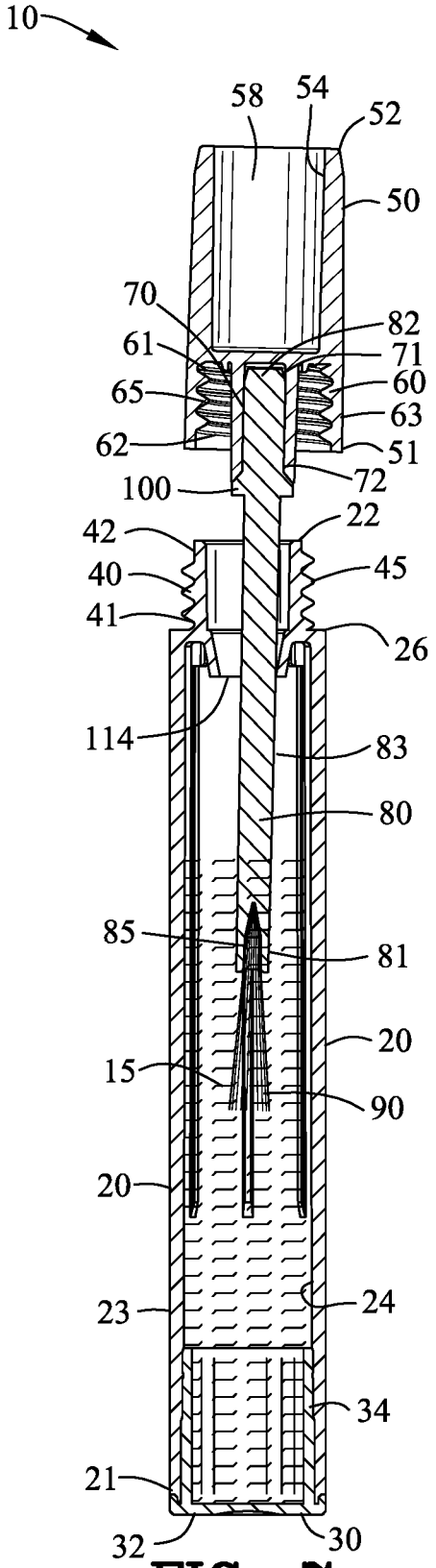
FIG. 7 is a side sectional view of a partial removal of the brush applicator from the liquid container.
Figure 8:
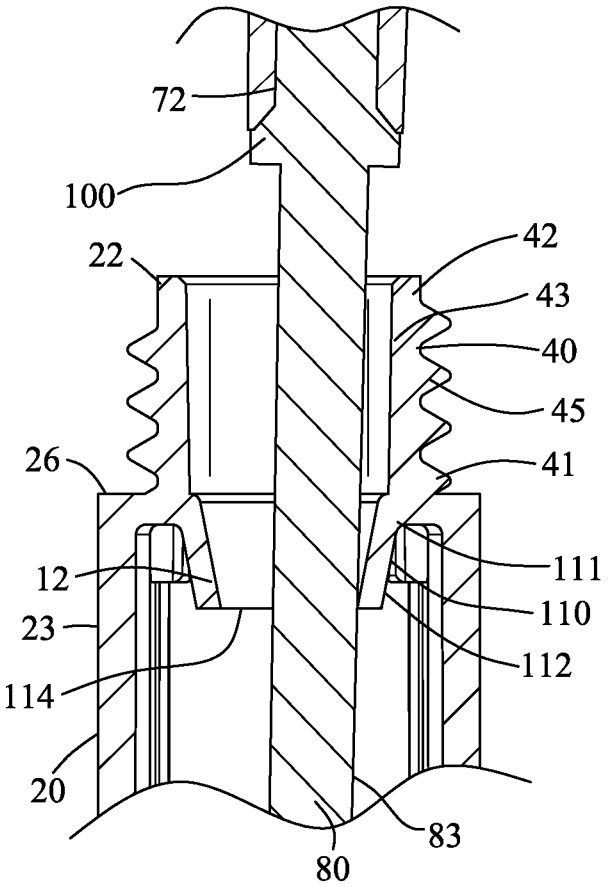
FIG. 8 is an enlarged view of a portion of FIG. 7.

FIGS. 7 and 8 are a side sectional view of the liquid applicator 90 partially removed from the container 20. The wiper seal 110 performs a second important function in addition to the second seal 12 set forth above.

The clearance between the aperture 114 and the cross-section of the rod 80 is selected to make it likely that the rod 80 will contact the depending end 112 of the wiper seal 110 for a user. The contact of the rod 80 with the depending end 112 of the wiper seal 110 is assisted by the natural movement of a typical operator tilting the closure 50 relative to the container 20. The contact of the rod 80 with the depending end 112 of the wiper seal 110 wipes excesses liquid from the rod 80.

In one example, the rod 80 has a diameter of 0.128 inches and the aperture 114 has a diameter of 0.201 inches rendering a clearance between the aperture 114 and the rod 80 of 0.073 inches or (57%) percent of the diameter of the rod 80.

Figure 9:
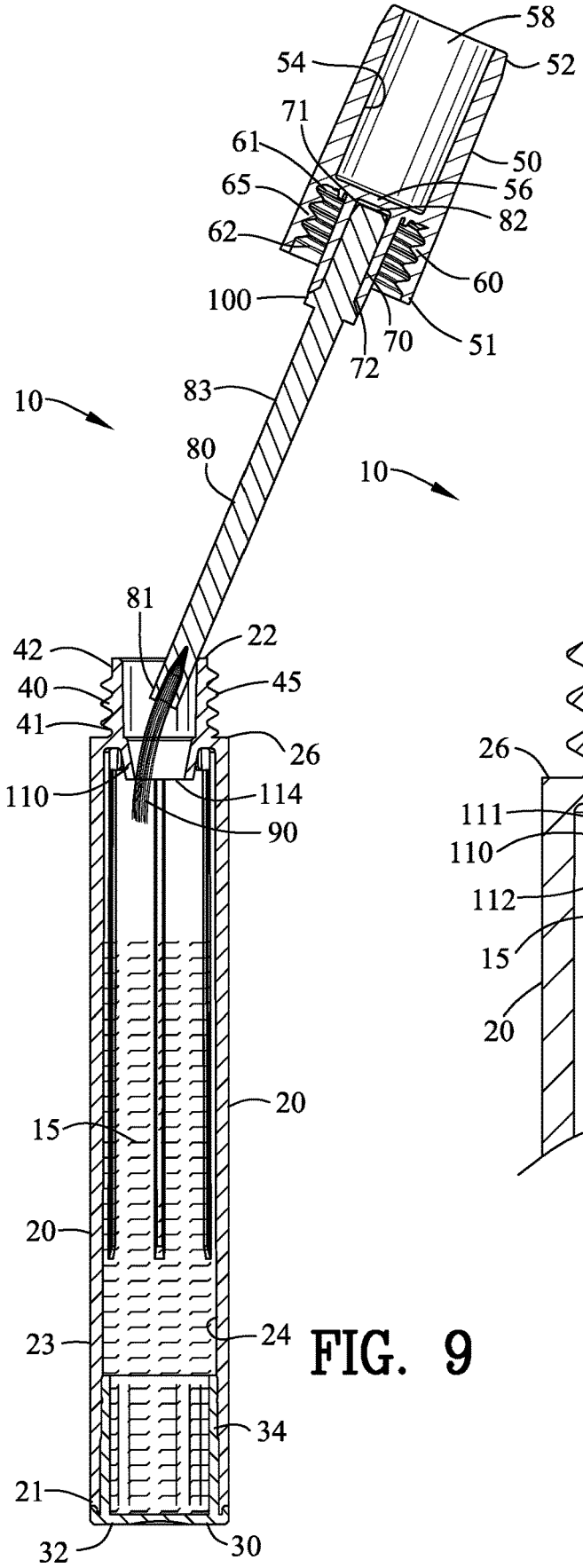
FIG. 9 is a side sectional view of a further removal of the brush applicator from the liquid container.
Figure 10:
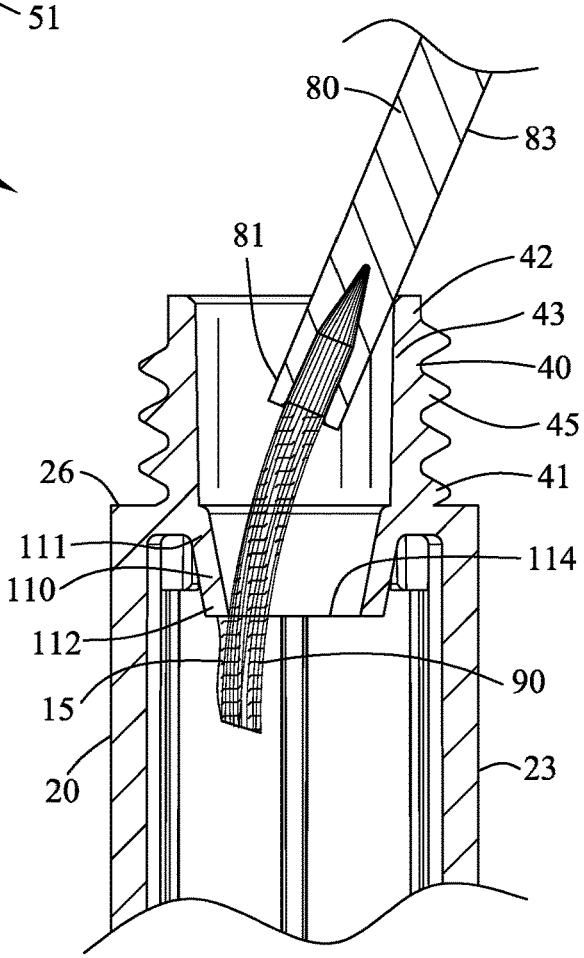
FIG. 10 is an enlarged view of a portion of FIG. 9.

FIGS. 9 and 10 are a side sectional view illustrating a further removal of the liquid applicator 90 from the container 20. The liquid applicator 90 is shown contacting the depending end 112 of the wiper seal 110. The contact of the liquid applicator 90 with the depending end 112 of the wiper seal 110 wipes excesses liquid from the liquid applicator 90.

The length of the rod 80 in combination with the clearance between the aperture 114 and the cross-section of the liquid applicator 90 makes it very likely that the liquid applicator 90 will contact the depending end 112 of the wiper seal 110 for a user.

The wiper seal 110 performs two important and independent functions. Firstly, the wiper seal 110 cooperates with the circumferential projection 100 of the rod 80 to form the second seal 12 between the container 20 and the closure 50. Secondly, the wiper seal 110 cooperates with the rod 80 and the liquid applicator 90 to wipe excesses liquid 15 from the rod 80 and the liquid applicator 90.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A dual seal for a liquid applicator for applying a liquid; comprising;

a liquid container having an open end with a container fastener;

a closure having a closure fastener for engaging with said container fastener for forming a first seal between said closure and said liquid container;

a rod extending from said closure for supporting a liquid applicator;

a circumferential projection extending from said rod having a diameter greater than said rod;

a resilient partially conical wiper extending from said liquid container for sealing with said circumferential projection of said rod for forming a second seal between said closure and said liquid container;

said resilient partially conical wiper having a clearance between said resilient partially conical wiper and said rod enabling said resilient partially conical wiper to wipe excess liquid from the rod, said closure including a socket for receiving an end of said rod; and said circumferential projection providing a stop for limiting insertion of said end of said rod into said socket in said closure.

2. A dual seal for a liquid applicator as set forth in claim 1, wherein said liquid container fastener includes container threads; and said closure fastener including closure threads for engaging with said container threads for forming said first seal between said closure and said liquid container.

3. A dual seal for a liquid applicator as set forth in claim 1, wherein said first seal comprises a compression seal between said closure and said liquid container.

4. A dual seal for a liquid applicator for applying a liquid comprising;

a liquid container having an open end with a container fastener;

a closure having a closure fastener for engaging with said container fastener for forming a first seal between said closure and said liquid container;

a rod extending from said closure for supporting a liquid applicator;

a circumferential projection extending from said rod having a diameter greater than said rod and greater than said liquid applicator;

a resilient partially conical wiper extending from said liquid container for sealing with said circumferential projection of said rod for forming a second seal between said closure and said liquid container; and said resilient partially conical wiper having a clearance between said resilient partially conical wiper and said rod and said liquid applicator for enabling said resilient partially conical wiper to wipe excess liquid from the rod and said liquid applicator only when said rod is tilted relative to said liquid container.

* * * * *